US008851664B2

(12) United States Patent
Spence

(10) Patent No.: US 8,851,664 B2
(45) Date of Patent: Oct. 7, 2014

(54) MAINTENANCE CART FOR MOVEABLE FLATBED MEDIA MARKING SYSTEM

(71) Applicant: James Joseph Spence, Honeoye Falls, NY (US)

(72) Inventor: James Joseph Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 80 days.

(21) Appl. No.: 13/670,121

(22) Filed: Nov. 6, 2012

(65) Prior Publication Data

US 2014/0125749 A1 May 8, 2014

(51) Int. Cl.

| | |
|---|---|
| ***B41J 2/01*** | (2006.01) |
| ***B41J 2/215*** | (2006.01) |
| *B41J 2/165* | (2006.01) |

(52) U.S. Cl.

CPC ..... *B41J 2/215* (2013.01); *B41J 2/16544* (2013.01); *B41J 2/16538* (2013.01); *B41J 2/16535* (2013.01); *B41J 2/16547* (2013.01)

USPC ..... 347/104; 347/22; 347/32; 347/33

(58) Field of Classification Search

CPC .... B41J 2/215; B41J 2/16547; B41J 2/16544; B41J 2/16535; B41J 2/16538

USPC ..... 347/104, 22, 32, 33

See application file for complete search history.

(56) References Cited

U.S. PATENT DOCUMENTS

| | | | |
|---|---|---|---|
| 5,051,761 | A | 9/1991 | Fisher et al. |
| 5,216,442 | A | 6/1993 | Parks et al. |

OTHER PUBLICATIONS

U.S. Appl. No. 13/464,356, filed May 4, 2012 to James Joseph Spence et al., entitled "Large Sheet Handling Using a Flatbed Sled".

U.S. Appl. No. 13/464,468, filed May 4, 2012 to James Joseph Spence et al., entitled "Air Bearing Substrate Media Transport".

*Primary Examiner* — Henok Legesse

(57) ABSTRACT

According to aspects described herein, there is disclosed a marking station maintenance apparatus comprising a cart frame moveable along a rail support track for passing a marking station. The marking station is configured to mark a substrate media sheet. A first motion support assembly facilitates motion of the cart frame along at least a first portion of the rail support track. The first motion support assembly extends from the cart frame. The first motion support assembly includes a glide surface providing a non-contact bearing support between an air-bearing surface of the first portion of the rail support track and the glide surface. A marking station cleaner is disposed on the cart frame and configured to clean a marking element of the marking station as the cart frame passes the marking station.

11 Claims, 8 Drawing Sheets

MAINTENANCE CART FOR MOVEABLE FLATBED MEDIA MARKING SYSTEM

INCORPORATION BY REFERENCE

The following U.S. patent applications are incorporated herein by reference in their entirety for the teachings therein: U.S. patent application Ser. No. 13/464,356, filed May 4, 2012, entitled "Large Sheet Handling Using A Flatbed Sled" and U.S. patent application Ser. No. 13/464,468, filed May 4, 2012, entitled "Air Bearing Substrate Media Transport", both of which are commonly assigned to the assignee hereof.

TECHNICAL FIELD

The present disclosure relates to apparatus and methods for servicing a substrate media marking system, particularly for cleaning elements of a marking station and rail support track used to convey the substrate media.

BACKGROUND

High speed inkjet marking devices for large-sized cut sheets are particularly constrained using contemporary systems with regard to production output, media type and image quality. Also, systems customized for handling large-sized cut sheets require service and maintenance like any other system. Generally, both contemporary and customized systems need to be taken off-line and have production interrupted in order to perform maintenance or other service.

Also, transporting large media, such as cut sheets as large as 60"×40", can be more difficult. In order to create a larger print zone, capable of efficiently printing onto large media, multiple marking elements such as an array of print heads is proposed herein. However, numerous marking elements can demand more service and cleaning, due to the increased likelihood that any one of those elements needs cleaning. Also, image quality can be an issue when printing across a large printing zone if it is not regularly cleaned. What is more, other marking station elements such as optical encoders and sheet transport systems need regular cleaning. Nonetheless, any increased maintenance that demands the system be taken off-line, will reduce production efficiency.

Accordingly, it would be desirable to provide a flexible, efficient and cost effective media transport system for marking large size cut sheet media that includes an apparatus and method for efficiently providing maintenance, minimizing how often the system needs to be taken off-line and overcomes other shortcomings of the prior art.

SUMMARY

According to aspects described herein, there is disclosed a marking station maintenance apparatus comprising a cart frame moveable along a rail support track for passing a marking station. The marking station is configured to mark a substrate media sheet. A first motion support assembly facilitates motion of the cart frame along at least a first portion of the rail support track. The first motion support assembly extends from the cart frame. The first motion support assembly includes a glide surface providing a non-contact bearing support between an air-bearing surface of the first portion of the rail support track and the glide surface. A marking station cleaner is disposed on the cart frame and configured to clean a marking element of the marking station as the cart frame passes the marking station.

Additionally, a second motion support assembly can be provided that facilitates motion of the cart frame along at least a second portion of the rail support track. The second motion support assembly can directly engage the second portion of the rail support track during movement thereon. The second motion support assembly can be disengaged from the rail support track when the first motion support assembly provides the non-contact bearing support. The second motion support assembly can include wheels providing rolling engagement upon the second portion of the rail support track when moving thereon. A track cleaning element can remove matter from the rail support track as the cart frame moves along the rail support track, the track cleaning element secured to the cart frame. The track cleaning element can include a pad for cleaning the air-bearing surface of the first portion of the rail support track. The marking station cleaner can include a wiping blade for engaging an inkjet plate of the marking element as the cart frame moves past the marking station. The marking station cleaner can include an ink drip pan for collecting ink wiped off the marking element by the wiping blade.

According to further aspects described herein, there is disclosed a railed flatbed printer apparatus with maintenance cart comprising a rail support track and a marking station for marking a substrate media sheet. The marking station is disposed along the rail support track. A media cart conveys the substrate media sheet along the rail support track. The media cart includes a planar bed for holding the substrate media sheet flat thereon. A maintenance cart is moveable along the rail support track separate from the media cart. The maintenance cart includes a marking station cleaner.

Additionally, the rail support track can include an air-bearing for supporting, with non-contact bearing support, the media cart and the maintenance cart respectively. The media cart and the maintenance cart can each include a first motion support assembly facilitating motion of the respective media cart and maintenance cart along at least a first portion of the rail support track. The first motion support assembly can include a glide surface providing a non-contact bearing support between the air-bearing and the glide surface. The media cart and the maintenance cart can each include a second motion support assembly facilitating motion of the respective media cart and maintenance cart along at least a second portion of the rail support track. The second motion support assembly can directly engage the second portion of the rail support track during movement thereon. The second motion support assembly can be disengaged from the rail support track when the first motion support assembly provides the non-contact bearing support. The marking station can include a plurality of inkjet heads, individual ones of the inkjet heads for marking the substrate media sheet on the planar bed. The marking station cleaner can include a wiping blade for engaging an inkjet plate of the marking station as the cart frame moves past the marking station. The maintenance cart can include an ink drip pan for collecting ink wiped off the marking element by the wiping blade.

According to further aspects described herein, there is disclosed a method of cleaning a marking station. The method comprises moving a maintenance cart along an air-bearing portion of a rail support track. The air-bearing portion of the rail support track extends past a marking station for marking substrate media sheets. The movement along the air-bearing portion being facilitated by a first motion support assembly extending from the maintenance cart. The first motion support assembly includes a glide surface providing a non-contact bearing support for the maintenance cart. The non-contact bearing support is between the air-bearing portion and the glide surface. The method also comprises cleaning a marking element of the marking station using a marking station cleaner mounted on the maintenance cart, the movement of the maintenance cart past the marking element enables the marking station cleaner to clean the marking element.

Additionally, cleaning the air-bearing portion of the rail support track can include using a pad mounted on at least a portion of the glide surface. The movement of the maintenance cart along the air-bearing portion of the rail support track can enable the pad to remove matter from the air-bearing portion. Cleaning the marking element can include passing a wiping blade across a surface of an inkjet plate of the marking element. The method can additionally comprise moving the maintenance cart along a second portion of the rail support track. The second portion of the rail support track can extend beyond the air-bearing portion of the rail support track. The movement along the second portion can be facilitated by a second motion support assembly. The second motion support assembly can directly engage the second portion of the rail support track during movement thereon. The second motion support assembly can be disengaged from the rail support track when the glide surface provides the non-contact bearing support for the maintenance cart. The second motion support assembly can include wheels providing rolling engagement upon the second portion of the rail support track. The method can additionally comprise moving a media cart along the air-bearing portion of a rail support track. The media cart can convey a substrate media sheet to the marking station.

DETAILED DESCRIPTION

Figure 1:
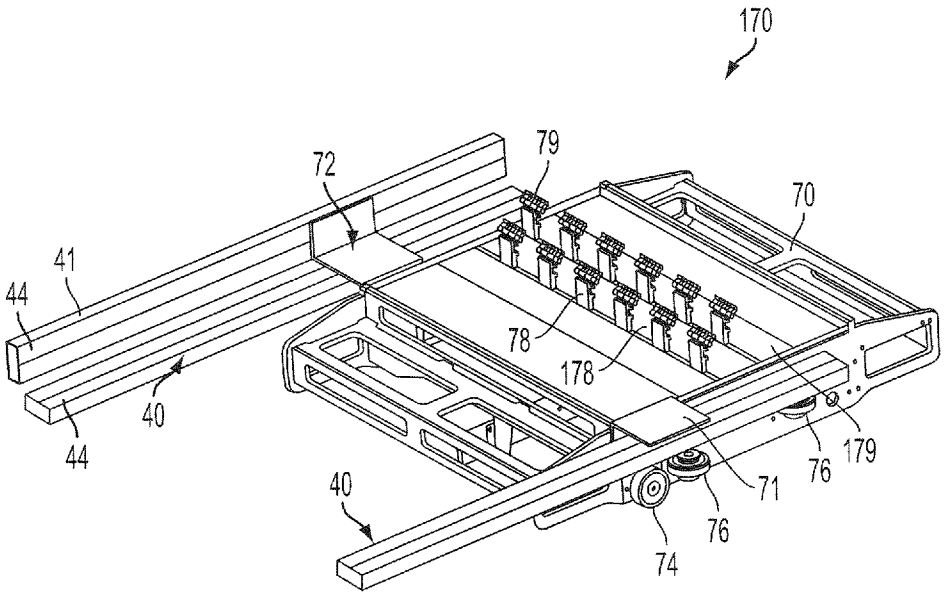
FIG. 1 is a perspective view of a marking station maintenance apparatus on a portion of a rail support track in accordance with an aspect of the disclosed technologies.

Describing now in further detail these exemplary embodiments with reference to the Figures. The disclosed technologies address multiple problems encountered in large format marking systems requiring high throughput architecture in a production environment. The apparatus and methods disclosed herein can be used as a stand-alone system or adapted to work with further marking systems.

As used herein, "marking station" refers to the location in a substrate media processing path in which the substrate media is altered by a "marking element." Marking by a marking element refers to making a mark or marks on a substrate media by leaving indicia through printing, stamping, cutting hitting or other means. Marking elements as used herein include a printer, a printing system, a printing assembly or a printing sub-assembly that marks substrate media. Such marking elements can use inkjet printing, digital copying, bookmaking, folding, stamping, facsimile, multi-function machine, and similar technologies.

Further marking elements include printers, printing assemblies or printing systems, which can use an "electrostatographic process" to generate printouts, which refers to forming an image on a substrate by using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printing system can print and/or handle either monochrome or color image data.

As used herein, "substrate media sheet", "substrate media" or "sheet" refers to a substrate onto which an image can be imparted. Such substrates may include, paper, transparencies, parchment, film, fabric, plastic, photo-finishing papers, corrugated board, or other coated or non-coated substrate media upon which information or markings can be visualized and/or reproduced. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in a process direction.

As used herein, the terms "process" and "process direction" refer to a process of moving, transporting and/or handling a substrate media sheet. The process direction substantially coincides with a direction of a flow path P along which a portion of the media cart moves and/or which the image or substrate media is primarily moved within the media handling assembly. Such a flow path P is said to flow from upstream to downstream. Accordingly, cross-process, lateral and transverse directions refers to movements or directions perpendicular to the process direction and generally along a common planar extent thereof.

As used herein, "cart," "media cart" or "maintenance cart" refers to a transport device translatable along a process path. A "media cart" more specifically refers to a cart for conveying a substrate media sheet, while a "maintenance cart" includes elements for performing maintenance on a marking station and/or a process path track along which the carts travel. It is contemplated herein that a single cart can include features of both a media cart and a maintenance cart. Such carts include a frame, also referred to herein as a "cart frame" for holding other elements, such as a media bed for directly supporting the substrate media sheet on a media cart or cleaning elements on the maintenance cart for keeping elements or portions of the overall system clean. Also, a cart as described herein can include a sled running on rails, a conveyance having wheels in rolling engagement with a track, other moveable carriage structure and/or any combination thereof.

Aspects of the disclosed technologies relate to a large modular conveyer system capable of including multiple stations. The conveyer is particularly suited for large sized paper, which can be held down onto a platen residing on top of a moving cart. The cart translates along a rail support track that constitutes a media path, within which multiple stations can be disposed. In particular, the stations can include a marking station, such as printing systems, or other functions like sheet loading, sheet registration, sheet cleaning, ink curing, sheet unloading and various functions that can be included in a marking system. Additionally, the stations and track generally require maintenance, thus the system includes a maintenance cart. The maintenance cart operates on the same track as the media cart, in order to provide efficient maintenance for the system without taking it off-line and promote improved output of high quality large prints.

The disclosed technologies are particularly suited for handling large substrate media sheets, particularly those that can accommodate for an image zone of 60"×40" with ability to handle paper size of approximately 62"×42". However, smaller paper sizes can still be accommodated by such a system, in addition to the larger sheets. Also, the system can be designed to handle even larger paper sizes, if desired. The use of a cart with platen to handle large size cut sheets of substrate media, provides the option to introduce printing onto multi-substrate materials such as, acrylic glass (PMMA), canvas, wallpaper, laminates, card boards, metal, aluminum, etc. In this way, a system controller operated from a user interface allows the system to adapt and accommodate various types substrates or ones of varying dimensions. Also, the cart or track can include sensors (not shown) for detecting substrate thickness. In addition to measuring sheet thickness, such sensors can also detect whether the leading edge of a sheet has raised off the platen. By automatically measuring the sheet leading edge height or the sheet thickness, the gap between the print heads and the sheet can automatically be adjusted. This can prevent the sheet from inadvertently slamming directly into the print heads. A maintenance cart 170, in accordance with the disclosed technologies, is particularly suited for keeping the marking stations and segments of rail support track clean for continued use.

Figure 2:
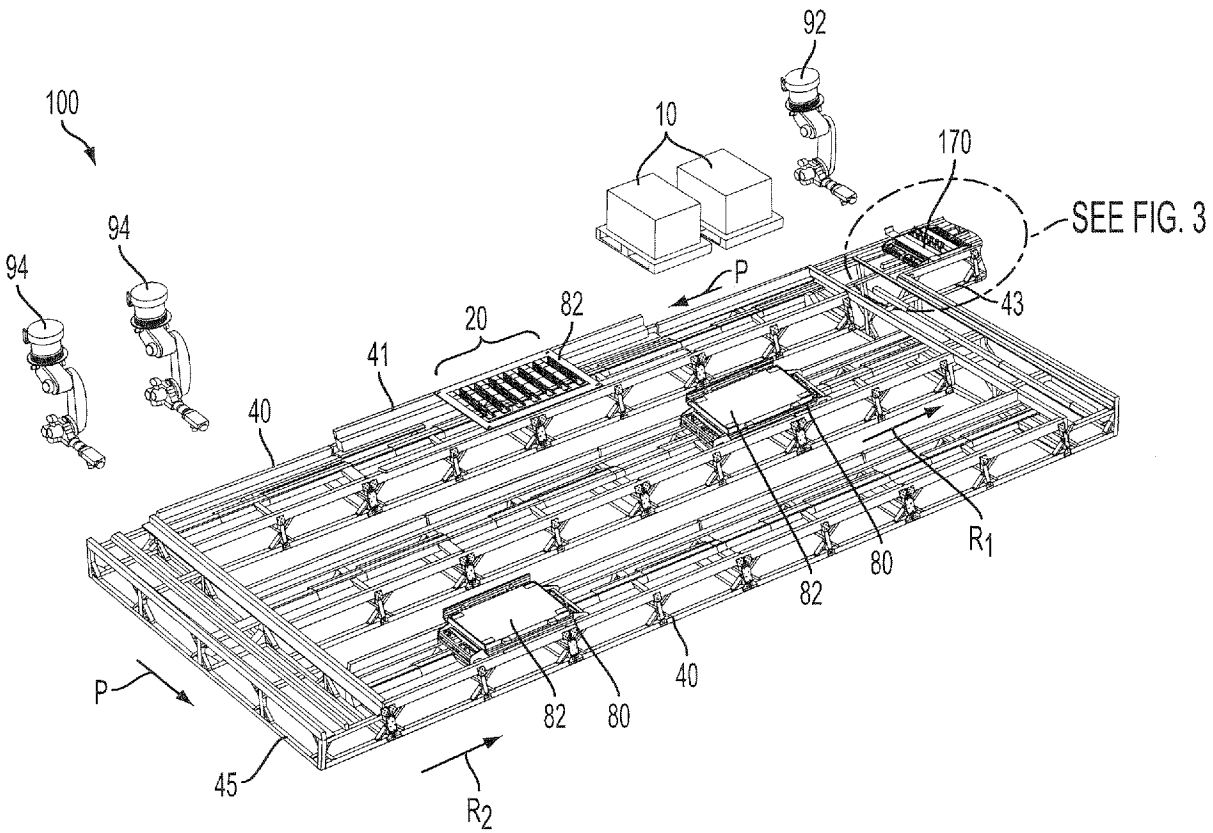
FIG. 2 is a perspective view of a railed flatbed printer apparatus with maintenance cart in accordance with aspect of the disclosed technologies.

FIG. 1 shows a maintenance sled 170 for a moveable flatbed media marking system in accordance with aspects of the disclosed technologies. The maintenance sled 170 is shown riding on a rail support track 40. The portion of the rail support track 40 shown in FIG. 1 can represent just a small section of track 40 over which the cart 170 can travel, or as shown in FIG. 2 can be part of a larger circuit of track 40 that includes a rail flatbed printing apparatus as well as additional optional stations for handling substrate media sheets 10. The maintenance cart 170 includes elements for cleaning and/or clearing a marking station 20 printing apparatus such as the print heads. Also elements are provided for wiping or clearing the rail support track 40 as the cart 170 traverses over those segments of track 40.

The maintenance sled includes a cart frame 70 which serves as the basic support for other elements of the maintenance cart 170. In accordance with one aspect of the disclosed technologies, the cart frame 70 supports a first motion support assembly 71, 72 that facilitates the motion of the cart frame 70 along the rail support system 40. As used herein, a "motion support assembly" refers to those elements of the apparatus supporting the substantial weight of the apparatus above either the contact or non-contact bearing surface over which it moves. In the embodiment shown, the rail support system 40 includes air bearing technology with a hovering glide surface as the first motion support assembly. In addition to low friction, air bearing provide precision motion for the maintenance cart 170. However, it should be understood that other motion support assembly structures could be provided as alternative first motion support assemblies, such as direct engagement glide skid, non-contact maglev, roller bearing or other suitable systems.

Air bearing technology generally consists of a porous non-bearing support surface that emits pressurized air supplied from below or within the porous surface. The air expelled through the porous surface creates a gaseous film above the porous surface over which a planar ski on the maintenance cart 170 can glide. The gaseous layer between the air bearing porous surface and a glide surface provided for the cart provides a virtually frictionless motion that can enhance motion quality along the rail support track. Thus, as the air bearing surface does not substantially engage the glide surface, it is referred to herein as a "non-contact bearing," with the air bearing surface referred to as a "non-contact bearing surface." Using non-contact bearing surfaces also provides precision position control, particularly the vertical position between the cart 170 and any marking station elements. Such air bearing technology can also be used to stabilize the lateral position of the maintenance cart 170. Accordingly, a lateral track wall 41 can include air bearings for providing non-contact bearing support in a cross process direction for the maintenance cart 170. In order to take advantage of the lateral track wall 41, the maintenance cart 170 should be biased towards that wall 41 and an additional glide surface should be provided extending from the cart frame 170 in order to glide across that wall 41.

The maintenance cart 170 also includes a marking station cleaner 178 that is disposed on the cart frame 70 and configured to clean a marking element of the marking station as the cart frame passes that marking element. In the embodiment shown, the marking station cleaner 178 represents an array of discreet cleaning members 78. Several cleaning members are arranged adjacent one another extending in two rows laterally across the cart frame 70. Each of the cleaning elements 78 extends vertically from the upper portion of the cart frame and is topped with a wiping blade 79, which is designed to engage a marking element of the marking station. In particular, the wiping blades 79 are configured to engage and wipe along an ink jet plate of an inkjet head as the maintenance cart 170 moves past the marking station. The marking station cleaner 178 can also include one or more drip pans 179 for catching and/or collecting residual ink wiped off the marking element by the wiping blades 79.

The maintenance cart 170 can additionally include a second motion support assembly 74, which also facilitates motion of the cart frame 70 along segments of the rail support track 40. In the embodiment shown, the second motion support assembly includes a set of four wheels designed to engage a bearing support surface of the rail support track 40. However, as with the first motion support assembly, the second motion support assembly can be any one of a number of alternative suitable designs. This second motion support assembly 74 is provided as an alternative to the first motion support assembly, which is an air-bearing support assembly that enables precision movement along the rail support track but is associated with higher costs. Additional spring loaded wheel biasing element 76 can be provided in order to laterally bias the cart towards a lateral retaining wall 41.

FIG. 2 shows an exemplary embodiment of an overall railed flatbed printing apparatus 100 with maintenance cart 170. The rail flatbed printing apparatus preferably includes a closed circuit rail support track that allows one or more media carts 80 to move along the rail support track 40. Preferably the rail support track 40 includes one or more marking stations 20 so that the carts 80, 170 can travel along the rail support track 40 in a process direction P. In this exemplary embodiment, the rail support track 40 includes more than one path $R_1$, $R_2$. In this way, different processes can be applied to substrate media sheets 10 that are handled by the system. The media cart 80 preferably includes a media bed or platen 82 for holding a substrate media sheet 10 flat thereon. In this way, as the media sheets 10 each pass under the marking station elements, they can be marked accordingly in this flat configuration. The substrate media sheets can be loaded onto the media cart 80 using an automated handler 92 and can similarly be removed by automated systems 94 at another point along the substrate media path.

In addition to the parallel segments of rail support track 40 that are shown, additional lateral traversing segments 45 can be provided, although certain segments of the rail support track need not be linear. In other words, an alternative embodiment could provide an arched or curved segment of track connecting other linear segments of track. Additionally, in accordance with an aspect of the disclosed technologies herein, an offline segment of track 43 is provided for parking the maintenance cart 170 during the normal cycles of media cart operation, while keeping it out of the way. Preferably, the offline segment of track 43 is conveniently located for the maintenance sled 170 to enter the process path P and perform its scheduled maintenance.

Figure 3:
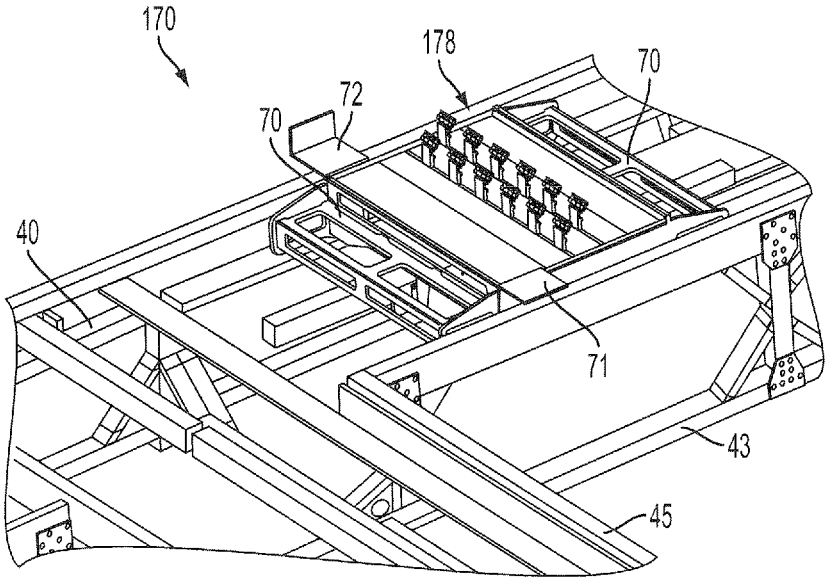
FIG. 3 is a relief perspective view of a portion of the maintenance cart of FIG. 2, as indicated therein.

FIG. 3 is a relief perspective view indicated within FIG. 2, showing the maintenance cart 170 in detail on the extension track 43. The maintenance cart transitions from the extension track 43 to the regular circuit of the rail support track.

Figure 4:
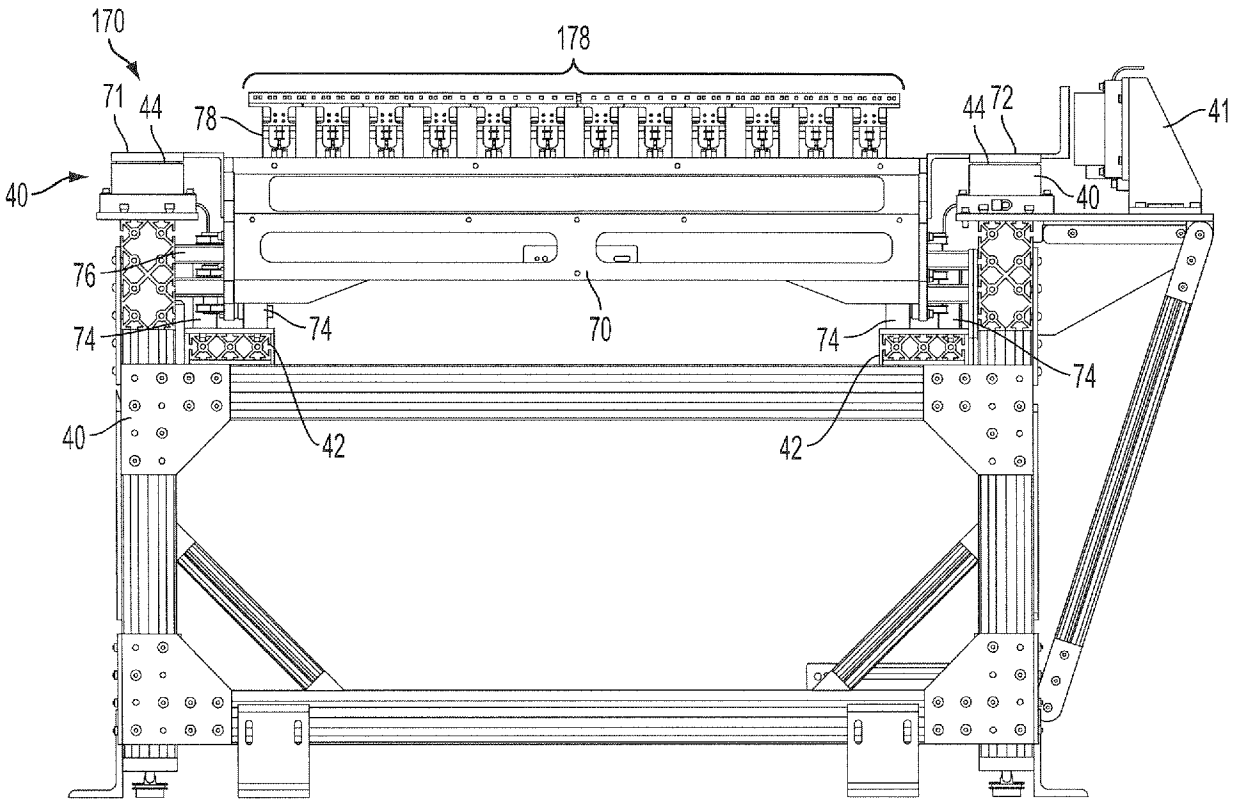
FIG. 4 is a rear elevation view of a maintenance cart on a rail support track in accordance with aspect of the disclosed technologies.

FIG. 4 shows a rear elevation view of the maintenance cart 170 on a cross-sectional view of the rail support track. The maintenance cart 170 is shown gliding across the air bearing surface of the rail support track 40. The cart frame 70 includes laterally biasing wheels 76 that are used to help position the maintenance cart 170 within the U-shaped frame which forms the base of the rail support track. Also shown are the wheels from the second motion support assembly 74. It should be noted that normally the second motion support assembly 74 will not engage the bearing surfaces 42 of the rail support track 40 at the same time that the first motion support assembly 71, 72 supports the maintenance sled 170 across the air bearing surfaces 44. In order to achieve this, the segments of track that include the bearing surfaces 42 generally drop down to a lower level by providing a ramp or transition zone. In this way, the media cart 80 or maintenance cart 170 reaches a segment of rail support track 40 that includes the air bearings, the wheels of the second motion support assembly will be in rolling engagement with the track bearing surface 42. Then, as it approaches the marking station 20, the bearing surfaces 42 of the track will drop down with a transition ramp (now shown) allowing the glide surfaces 71, 72 to take over the support of the cart frame, but in a non-contact manner. Accordingly, FIG. 4 shows the wheels 74 dropped down below a higher section of bearing surface track 42 (after each having rolling down a transition ramp) and thus appear partially obstructed by the track bearing surface 42. The lower section of bearing surface track 42 should be low enough that the wheels do not engage that surface, since while moving down the transition ramp the first motion support assembly 71, 72 takes over.

Figure 5:
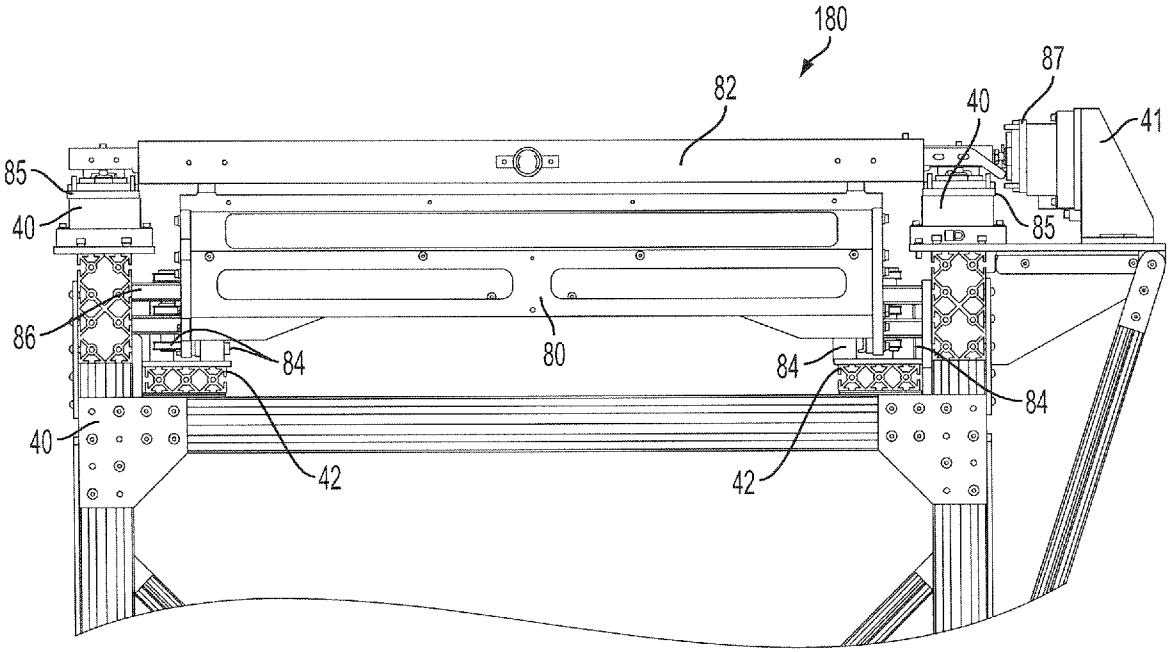
FIG. 5 is a rear elevation view of a media cart on a rail support track in accordance with aspect of the disclosed technologies.

FIG. 5 shows a similar cross section of rail support track 40 but this time supporting a media cart 180. The media cart similarly includes a cart frame 80 and a first motion support assembly 85 for gliding along the air bearing surfaces of the rail support track 40. Also, lateral biasing wheels 86 help maintain the cart 180 positioned in the cross process direction on the track in conjunction with the lateral support wall 41 and lateral air bearing surface 87. The cart frame 80 includes a substrate media bed 82 for holding a sheet 10 of substrate media. Also, as with the maintenance cart 170 noted earlier, the media cart 180 includes a second motion support assembly 84 for supporting the media cart 180 along the bearing support surfaces 42 of the rail support track 40. It is advantageous for the media cart 180 and the maintenance cart 170 to each include similar first motion support assemblies so that both carts 170, 180 can take advantage of the same track surfaces. Also, the media cart 180 and the maintenance cart 170 can include the similar second motion support assembly for similarly using the same types of secondary rail support track. Both carts 170, 180 would directly engage the rail support track bearing surfaces 42 with their second motion support assemblies, but would disengage from those bearing surfaces 42 when the first motion support assembly 71, 72 takes over with its non-contact bearing support.

Figure 6:
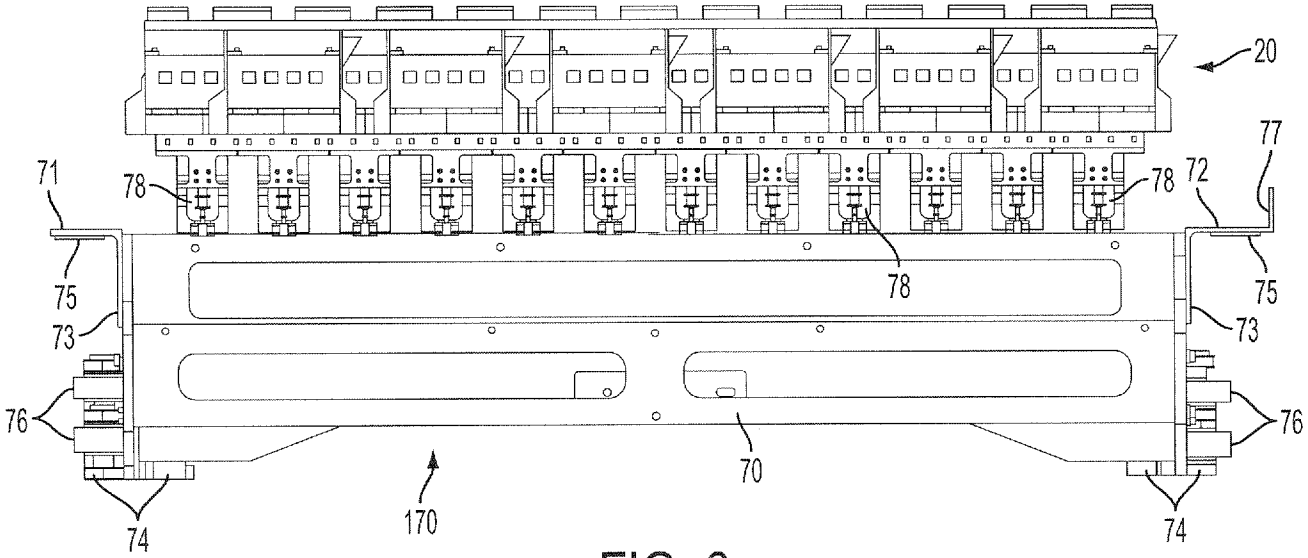
FIG. 6 is a rear elevation view of a maintenance cart cleaning print heads in a marking station, in accordance with aspect of the disclosed technologies.

FIG. 6 shows a rear elevation view of a maintenance cart 170 interacting with the print heads of a marking station 20. As shown, the individual cleaning elements 78 engage the print heads in order to remove extraneous ink that builds up thereon. Also shown are the first motion support assembly elements 71, 72. The left side element 71 (in accordance with the orientation shown in FIG. 6) has an L-shaped cross section. The vertical leg 73 of this brace type element is preferably secured to the cart frame 70, then a horizontal element projects away from the cart frame towards the outside of the rail support track 40. Preferably, at least a portion of that horizontal surface includes a pad 75 for cleaning the air-bearing surface 44 of the rail support track 40 (now shown). Such pads 75 could include tear away cleaning pads so that a fresh new cleaning surface can be provided between cleaning passes. The pads 75 extend downwardly from the horizontal surface toward the air-bearing surface 44 and may lightly touch the air-bearing surface 44 to remove contaminants therefrom.

Similarly, the right side element 72 of the first motion support assembly includes the lower vertical portion 73 which is attached to the cart frame 70. Also, it includes the intermediate horizontal portion with the pad 75, but additionally it includes a further vertical portion 77, which is used to guide and clean the lateral retaining air bearing wall 41 (not shown). Additionally, further details of the secondary motion support assembly 74 are shown on the lower portion of the cart frame 70. These lower bearing wheels could be used along the bearing support surfaces 42 of the rail support track 40 (not shown). Further, the lateral biasing wheels 76 are shown on both sides of the cart frame. It should be understood that while the biasing wheels preferably bias the cart frame towards the lateral retaining wall 41, they can otherwise maintain the cart generally centered and stable along the rail support track as it travels along segments of that track but do not use the air bearing technology.

Figure 7:
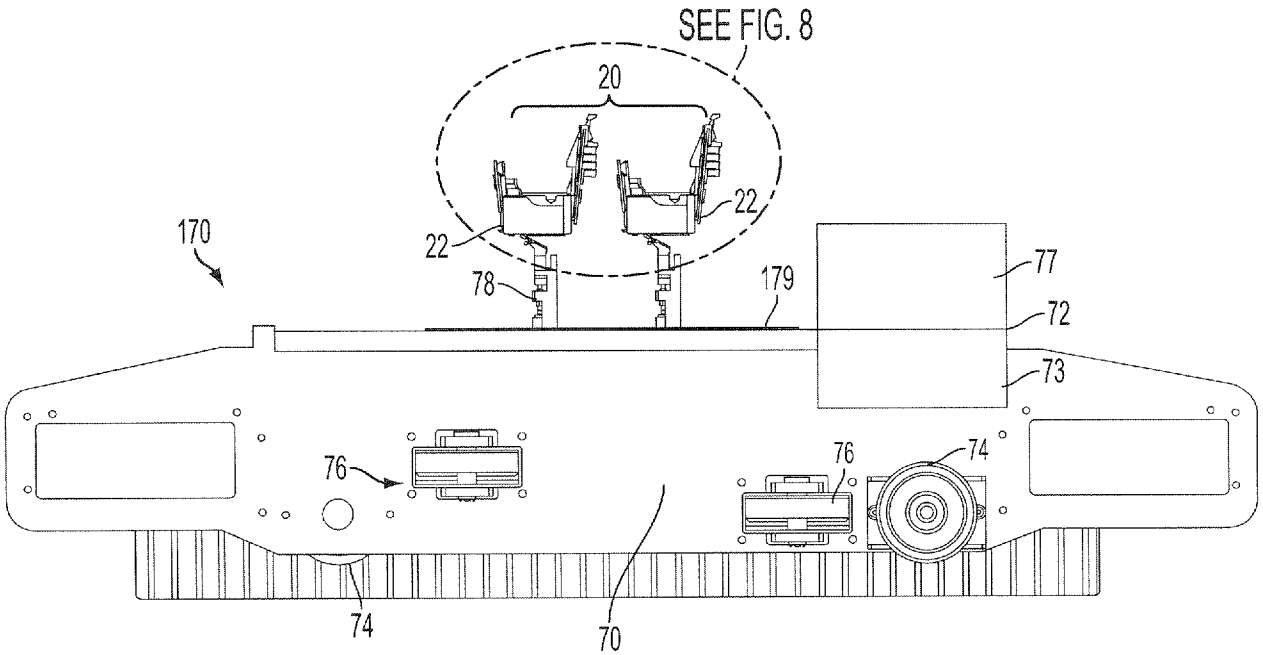
FIG. 7 is a side elevation view of the maintenance cart and marking station elements of FIG. 6.

FIG. 7 shows a side elevation view of the maintenance cart 170 shown in FIG. 6. The first motion support assembly glide elements are shown closer to a leading edge of the cart frame 70 (only one of the first motion support assembly guide elements 72 is visible in the orientation shown). However, it should be understood that an additional set of glide elements could also be provided towards the rear of the cart frame 70 in order to balance the overall structure. Such an additional set of glide elements can be disposed just behind the drip pan 179 (as per the configuration shown). Also, as yet a further alternative, the glide surfaces of the first motion support assembly could be provided in a more central portion of the cart frame 70 such as adjacent to the marking station cleaning elements 78 (which in the orientation of FIG. 7 would obstruct the view of cleaning elements 78). Also, more clearly seen in FIG. 7 is the ink drip pan 179 which is alternatively provided to collect ink wiped off the inkjet plates 24 of the print heads 22.

Figure 8:
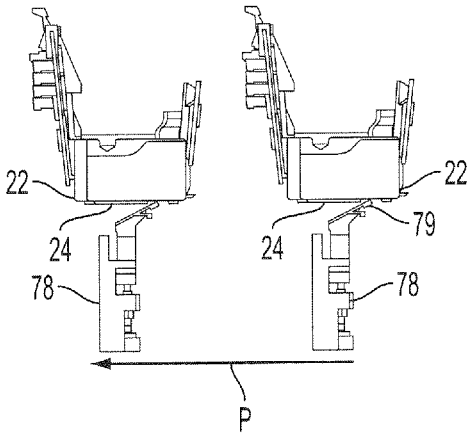
FIG. 8 is a side elevation relief view showing wiping blades engaging the inkjet plates of inkjet heads of FIG. 7, as indicated therein.

FIG. 8 shows a side elevation relief view taken as indicated within FIG. 7, but from the opposite side (both sides being substantially mirror images of one another). This illustration shows in further detail how the wiping blade 79 of the cleaning element 78 engages the lower horizontal ink jet plate 24 of the marking stations ink jet heads 22. An ink jet plate 24 is a type of plate used for computer-to-plate systems in which an ink fluid is sprayed onto a metal base to create an image plate from the digital record. Creating an image from digital files allows the image to occur without the use of lasers or any other types of exposure. Such ink jet plates 24 are generally known in the art. Such ink jet heads 22 form marking elements of the marking station 20 in accordance with this aspect of the disclosed technologies. Thus, as the maintenance cart 170 travels in a process direction P, the wiping blades 79 slide (from right to left in the configuration shown) across the surface of the ink jet plates 24. Alternatively, the marking station cleaning element could employ a vacuum, liquid flush or purging system for cleaning print heads.

Additionally, encoders can be positioned either on the carts 170, 180 or somewhere on the track 40 in order to monitor the speed of the carts. Used in conjunction with a system controller, determining the precise speed of the carts 170, 180 enables the proper and precise marking sequence and helps the cleaning process. Having a proper firing sequence of print heads can improve quality for pixel placement on the substrate media sheet. Also, ensuring that the carts translate through the marking station at a constant velocity will further help image quality. Thus, the maintenance cart 170 can further include an element for cleaning optical encoders.

Both the maintenance cart 170 and media cart 180 can include the same types of propulsion systems driving the dynamic motion of each cart. Such propulsion systems can include an on board motor which moves gears or wheels, thus enabling cart motion. Also, non-contact motor drive systems could enable carts to move freely without tether lines (power or signal) constraints. One such drive system uses magnetic propulsion, which enables varying speeds, including stopping and restarting, thus controlling cart movement as desired. A central or lateral rail could be provided to house elements such as a magnetic propulsion system. Alternatively, a direct drive system using pulleys, cables, chains or other similar systems could be employed to drive the carts.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A marking station maintenance apparatus comprising:

a cart frame moveable along a rail support track for passing a marking station, the marking station configured to mark a substrate media sheet;

a first motion support assembly facilitating motion of the cart frame along at least a first portion of the rail support track, the first motion support assembly extending from the cart frame, the first motion support assembly including a glide surface providing a non-contact bearing support between an air-bearing surface of the first portion of the rail support track and the glide surface;

a marking station cleaner disposed on the cart frame and configured to clean a marking element of the marking station as the cart frame passes the marking station; and a second motion support assembly facilitating motion of the cart frame along at least a second portion of the rail support track, the second motion support assembly directly engaging the second portion of the rail support track during movement thereon, the second motion support assembly being disengaged from the rail support track when the first motion support assembly provides the non-contact bearing support.

2. The apparatus as defined in claim 1, wherein the second motion support assembly includes wheels providing rolling engagement upon the second portion of the rail support track when moving thereon.

3. The apparatus as defined in claim 1, further comprising:

a track cleaning element for removing matter from the rail support track as the cart frame moves along the rail support track, the track cleaning element secured to the cart frame.

4. The apparatus as defined in claim 3, wherein the track cleaning element includes a pad for cleaning the air-bearing surface of the first portion of the rail support track.

5. The apparatus as defined in claim 3, wherein the marking station cleaner includes a wiping blade for engaging an inkjet plate of the marking element as the cart frame moves past the marking station.

6. The apparatus as defined in claim 5, wherein the marking station cleaner includes an ink drip pan for collecting ink wiped off the marking element by the wiping blade.

7. A method of cleaning a marking station, the method comprising:

moving a maintenance cart along an air-bearing portion of a rail support track, the air-bearing portion of the rail support track extending past a marking station for marking substrate media sheets, the movement along the air-bearing portion facilitated by a first motion support assembly extending from the maintenance cart, the first motion support assembly including a glide surface providing a non-contact bearing support for the maintenance cart, the non-contact bearing support being between the air-bearing portion and the glide surface;

cleaning a marking element of the marking station using a marking station cleaner mounted on the maintenance cart, the movement of the maintenance cart past the marking element enabling the marking station cleaner to clean the marking element; and moving the maintenance cart along a second portion of the rail support track, the second portion of the rail support track extending beyond the air-bearing portion of the rail support track, the movement along the second portion facilitated by a second motion support assembly, the second motion support assembly directly engaging the second portion of the rail support track during movement thereon, the second motion support assembly being disengaged from the rail support track when the glide surface provides the non-contact bearing support for the maintenance cart.

8. The method as defined in claim 7, further comprising:

cleaning the air-bearing portion of the rail support track using a pad mounted on at least a portion of the glide surface, the movement of the maintenance cart along the air-bearing portion of the rail support track enabling the pad to remove matter from the air-bearing portion.

9. The method as defined in claim 7, wherein cleaning the marking element includes passing a wiping blade across a surface of an inkjet plate of the marking element.

10. The method as defined in claim 7, wherein the second motion support assembly includes wheels providing rolling engagement upon the second portion of the rail support track.

11. The method as defined in claim 7, further comprising:

moving a media cart along the air-bearing portion of a rail support track, the media cart conveying a substrate media sheet to the marking station.

* * * * *